US009970293B2

(12) United States Patent
Assaf

(10) Patent No.: US 9,970,293 B2
(45) Date of Patent: May 15, 2018

(54) LIQUID RING ROTATING CASING STEAM TURBINE AND METHOD OF USE THEREOF

(71) Applicant: Agam Energy Systems Ltd., Hod Hasharon OT (IL)

(72) Inventor: Gad Assaf, Beer Sheva (IL)

(73) Assignee: Agam Energy Systems Ltd., Hod Hasharon (IL)

( * ) Notice: Subject to any disclaimer, the term of this patent is extended or adjusted under 35 U.S.C. 154(b) by 0 days. days.

(21) Appl. No.: 15/245,287

(22) Filed: Aug. 24, 2016

(65) Prior Publication Data

US 2017/0037727 A1 Feb. 9, 2017

Related U.S. Application Data

(63) Continuation of application No. 13/583,527, filed as application No. PCT/IL2011/000223 on Mar. 9, 2011, now Pat. No. 9,453,412.

(30) Foreign Application Priority Data

Mar. 9, 2010 (IL) ..... 204389

(51) Int. Cl.
*F04C 7/00* (2006.01)
*F04C 19/00* (2006.01)
*F01C 7/00* (2006.01)

(52) U.S. Cl.
CPC ..... *F01C 7/00* (2013.01); *F04C 19/002* (2013.01); *F04C 19/004* (2013.01)

(58) Field of Classification Search
CPC . F01C 7/00; F04C 7/00; F04C 19/00–19/008; F01K 11/02
USPC ..... 60/643, 645, 649, 669, 641.2; 418/1, 418/161, 50; 417/68, 69
See application file for complete search history.

(56) References Cited

U.S. PATENT DOCUMENTS 1,463,646 A 7/1923 Constantin
2,815,003 A 12/1957 Kumm
2,937,499 A 5/1960 Hermann
(Continued)

FOREIGN PATENT DOCUMENTS

DE 3718551 A1 12/1988
DE 102006049944 A1 3/2008
(Continued)

OTHER PUBLICATIONS

Office Action dated Dec. 23, 2012, from Israel Patent Office in the corresponding application in Israel, citing U.S. Pat. No. 7,066,718 as rendering the claims allegedly obvious.

*Primary Examiner* — Laert Dounis
(74) *Attorney, Agent, or Firm* — Nixon Peabody LLP

(57) ABSTRACT

A rotating liquid ring rotating casing gas turbine (10) has at least one liquid ring rotating casing (13) having an eccentrically mounted impeller (11) adapted to rotate within a surrounding liquid ring (14) so as to form chambers (15) of successively increasing volume between adjacent vanes of the impeller. A working fluid formed by high pressure gas is injected into the impeller where the chambers are narrow via a fluid inlet (19) within a static axial bore (23) of the impeller so as to rotate the impeller and in so doing the gas expands isentropically. A fluid outlet (20) within the static axial bore of the impeller and fluidly separated from the fluid inlet allows the working fluid to escape at low pressure and low temperature.

9 Claims, 6 Drawing Sheets

(56) References Cited

U.S. PATENT DOCUMENTS

| | | | | |
|---|---|---|---|---|
| 3,423,078 | A | 1/1969 | May | |
| 4,112,688 | A | 9/1978 | Shaw | |
| 4,152,898 | A | 5/1979 | Awerbuch | |
| 4,428,200 | A | 1/1984 | McCabe | |
| 5,636,523 | A | 6/1997 | Assaf | |
| 5,722,255 | A | 3/1998 | Brasz | |
| 7,066,718 | B2 | 6/2006 | Haga | |
| 2008/0314041 | A1 | 12/2008 | Assaf | |
| 2009/0290993 | A1 | 11/2009 | Assaf | |
| 2014/0147244 | A1* | 5/2014 | Cantemir | F01C 7/00 415/1 |

FOREIGN PATENT DOCUMENTS

| | | | |
|---|---|---|---|
| GB | 2270119 | A | 3/1994 |
| WO | WO 96/22467 | | 7/1996 |

* cited by examiner

LIQUID RING ROTATING CASING STEAM TURBINE AND METHOD OF USE THEREOF

CROSS-REFERENCE TO RELATED APPLICATIONS

This application is a continuation of and claims priority to U.S. patent application Ser. No. 13/583,527, filed Sep. 7, 2012, now allowed, which is a U.S. National Phase Application of International Application No. PCT/IL2011/000223, filed Mar. 9, 2011, which claims the benefit of priority to Israeli Application No. 204389, filed Mar. 9, 2010, each of which is hereby incorporated by reference herein in its entirety.

FIELD OF THE INVENTION

The present invention relates to heat engines and more particularly to Liquid Ring Rotating Casing Compressor (LRRCC) heat engines.

BACKGROUND OF THE INVENTION

In a liquid ring expander, an impeller with blades mounted on it is mounted eccentrically in an expander body. A service liquid is present in the expander body and is flung against the wall of the expander body as a result of the centrifugal forces generated by rotation of the impeller. The volume of the service liquid is less than the volume of the expander body. In this way, the service liquid in the expander body forms a circumferential liquid ring which forms chambers bounded in each case by two blades and the liquid ring. Owing to the eccentric positioning of the impeller in the expander body, the size of the chambers increases in the direction of rotation of the impeller, thus allowing gas introduced at high pressure into the narrow chambers of the expander to expand and thereby rotate the impeller.

A liquid ring compressor operates in an analogous manner, only in this case gas is introduced into the widest chamber of the expander such that the size of the chambers decreases in the direction of rotation of the impeller. Owing to the rotation of the impeller and the reduction in the size of the chambers, the gas which has been drawn in is compressed and ejected from the liquid ring expander on the high pressure side.

US 2008/0314041 (corresponding to IL 163263) in the name of the present inventor discloses a heat engine that includes at least one Liquid Ring Rotating Casing Compressor (LRRCC) having a fluid inlet and a fluid outlet, a combustion chamber in fluid communication with the output of the LRRCC, and at least one expander having a fluid inlet and a fluid outlet. The fluid inlet communicates with the combustion chamber. Efficient LRRCC compressors/turbines are also known from EP 804 687.

The contents of both US 2008/0314041 and EP 804 687 are incorporated herein by reference.

In the heat engine described in US 2008/0314041, an LRRCC is used in tandem with an expander, which may be a conventional turbine or a liquid ring expander of the kind described above. In the case where the turbine is a liquid ring expander having arotating casing, air at high pressure and high temperature is injected into the casing so as to rotate the impeller.

Liquid ring turbines are only feasible if the casing rotates together with the impeller since the friction between the impeller and a fixed casing is prohibitive to obtaining reasonable efficiency. Rotating casing rotating liquid ring turbines are known in the literature but have so far been only theoretical based on the physical principle that an expander is complementary to a compressor. While this is, of course, true in principle, practical rotating casing liquid ring turbines do not appear to have been realized and most turbines currently in use employ very high pressure steam to rotate the turbine at high speeds. As is well-known, several turbines are often employed in cascade, the steam emitted from one turbine being use to rotate the next turbine and so on, until the pressure of the steam is too low to be of effective use. The steam is then cooled using cold water which may come from a river, the sea or a cooling tower.

The use of steam in a rotating casing rotating liquid ring turbine has been proposed by U.S. Pat. No. 4,112,688 (Shaw), which describes a rotating liquid ring turbine driven by an expanding gas and having a rotating casing. Shaw requires that no change of phase occurs in the energy transfer medium as, for example, occurs in the case of the Rankine turbine cycle in which water is converted to steam and back again with unavoidable energy losses, and reduced operating efficiency.

However, in order to meet this requirement, energy must be constantly supplied during the expansion phase to maintain the working medium as steam and thus prevent it from condensing. This is achieved by the provision of heat exchangers in the impeller.

As described, for example, in Wikipedia®, use of the Rankine cycle is well established in steam turbines where a pump is used to pressurize working fluid received from a condenser as a liquid instead of as a gas. All of the energy in pumping the working fluid through the complete cycle is lost, as is all of the energy of vaporization of the working fluid, in the boiler. This energy is lost to the cycle in that first, no condensation takes place in the turbine; all of the vaporization energy being rejected from the cycle through the condenser. But pumping the working fluid through the cycle as a liquid requires a very small fraction of the energy needed to transport it as compared to compressing the working fluid as a gas in a compressor (as in the Carnot cycle).

The working fluid in a Rankine cycle follows a closed loop and is reused constantly. The water vapor with entrained droplets often seen billowing from power stations is generated by the cooling systems (not from the closed-loop Rankine power cycle) and represents the waste energy heat (pumping and vaporization) that could not be converted to useful work in the turbine.

One of the principal advantages the Rankine cycle holds over others is that during the compression stage relatively little work is required to drive the pump, the working fluid being in its liquid phase at this point. By condensing the fluid, the work required by the pump consumes only 1% to 3% of the turbine power and contributes to a much higher efficiency for a real cycle. The benefit of this is lost somewhat due to the lower heat addition temperature as compared with gas turbines, for instance, which have turbine entry temperatures approaching 1500° C. FIG. 1 is a Temperature (T)-Entropy (S) diagram for the conventional Rankine cycle (based on open source data in Wikipedia®), showing that there are four processes identified as follows:

Process 1-2: The working fluid is pumped from low to high pressure; as the fluid is a liquid at this stage the pump requires little input energy.

Process 2-3: The high pressure liquid enters a boiler where it is heated at constant pressure by an external heat source to become a dry saturated vapor.

Process 3-4: The dry saturated vapor expands through a turbine, generating power. This decreases the temperature and pressure of the vapor, and some condensation may occur.

Process 4-1: The wet vapor then enters a condenser external to the turbine where it is condensed at a constant pressure to become a saturated liquid.

In an ideal Rankine cycle the pump and turbine would be isentropic, i.e., the pump and turbine would generate no entropy and hence maximize the net work output. Processes 1-2 and 3-4 would be represented by vertical lines on the T-S diagram and more closely resemble that of the Carnot cycle. The Rankine cycle shown in FIG. 1 prevents the vapor ending up in the superheat region after the expansion in the turbine, which reduces the energy removed by the condensers.

Point 3 lies on the envelope of the T-S curve that delineates between vapor and gas. Thus, if the working fluid is water, to the right of point 3, the working fluid is pure steam while to the left, i.e. within the envelope of the T-S curve it is wet steam and to the left of point 1, it is water. In practice, it is considered undesirable in a practical turbine to reduce the temperature of the working fluid from 3 to 4 since the steam is wet and when water droplets impinge at high pressure on the turbine blades they are liable to cause damage such as pitting and erosion of the blades. This derogates from the performance of the turbine and in time causes irreversible damage, rendering the blades unusable. This problem has been solved using special materials that are resistant to erosion, but these are very expensive.

To avoid pitting caused by wet steam while using conventional materials, it is common to employ superheating of the steam at point 3, so as to raise the temperature to close to 1,000° C. before being directed on to the turbine blades. Superheating, shown by the chain-dotted line, dries the steam thus avoiding the problem of pitting of the turbine blades. Typically, the steam is allowed to condense to a point denoted by 5 on the T-S curve, where its temperature is much reduced and is then re-heated and directed again on to the turbine blades as dry steam where it loses heat and strikes the T-S curve at point 6 where its entropy (S) is significantly higher than that for the conventional Rankine cycle without superheating.

In summary, the Rankine cycle requires either that special materials are used for the turbine blades in which case isentropic heat-energy conversion is possible but at the cost of highly expensive turbine blades; or superheating is required so as to ensure that during the heat-energy conversion stage the steam is maintained dry. This reduces the overall efficiency of the engine.

The present invention seeks to offer the benefits of a near-Rankine cycle which is essentially isentropic without requiring the steam to be dry during the heat-energy conversion stage.

SUMMARY OF THE INVENTION

One object of the invention is to employ steam in a rotating casing rotating 30 liquid ring turbine while avoiding condensation of the steam at least until it has done sufficient work, thereby rendering it effective as a propellant.

It is another object to provide a gas turbine that uses a partial Rankine cycle, which is essentially isentropic but does not require the steam to be dry during the heat-energy conversion stage.

According to one aspect of the invention there is provided a rotating liquid ring rotating casing gas turbine, comprising:

at least one liquid ring rotating casing having an eccentrically mounted impeller adapted to rotate within a surrounding liquid ring so as to form chambers of successively increasing volume between adjacent vanes of the impeller, a fluid inlet within a static axial bore of the impeller for injecting a fluid as a gas at high pressure into the impeller where the chambers are narrow so as to rotate the impeller and in so doing to expand essentially isentropically, and a fluid outlet within the static axial bore of the impeller and fluidly separated from the fluid inlet for allowing the fluid to escape at low pressure and low temperature.

According to another aspect of the invention there is provided a heat engine that includes such a turbine.

A major benefit of such an approach is that no compressor is required, thus saving energy and increasing the thermodynamic efficiency. This in turn means that a heat engine employing the rotating liquid ring rotating casing gas turbine is smaller and suitable for relatively low-power applications operating at low temperature and speed. For example, as distinct from conventional turbines that operate in excess of 130° C. and have an efficiency of approximately 12%, the turbine according to the invention can operate at as low as 100° C. and yet has an efficiency of 16%.

Yet a further benefit is that the turbine according to the invention may employ an open water cycle where cold water after condensation does not need to be re-heated to form steam as is commonly done in steam turbines. Thus, while the invention could also employ a closed cycle if desired, better thermodynamic performance is achieved by using a constant source of geothermically heated water, where the wet steam leaving the turbine is condensed and returned to the atmosphere.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

In the following description of some embodiments, identical components that appear in more than one figure or that share similar functionality will be referenced by identical reference symbols.

Figure 2:
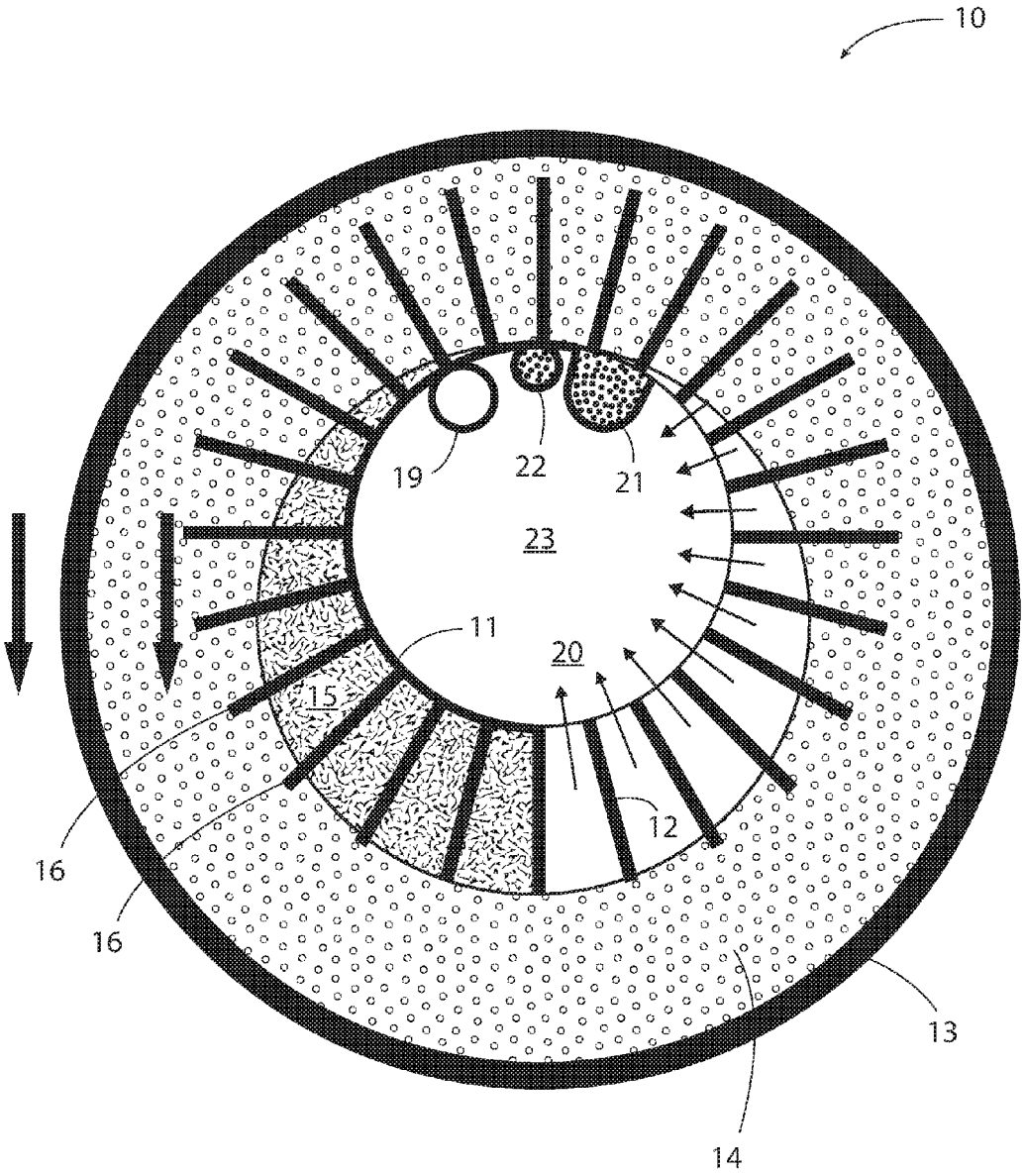
FIG. 2 shows schematically a cross-section of a LRRC steam turbine having an external steam condenser according to a first embodiment of the invention.

Referring to FIG. 2, there is shown in schematic cross-section a rotating liquid ring turbine wherein an impeller 11 with radial blades 12 rotates counter-clockwise around static ducts. The impeller is enclosed by a rotating casing 13 that contains a liquid ring 14 and rotates about an axis that is parallel but eccentric to the axis of the impeller so as to form chambers 15 bounded in each case by two blades 16 and the liquid ring. A mechanical coupling such as partially meshing annular gear trains 17 and 18 may be provided between the impeller and the casing so as to rotate the impeller and the casing at a similar rate. Owing to the eccentric positioning of the impeller in the rotating casing, the chambers increase in size in the direction of rotation of the impeller.

A fluid inlet 19 is provided near where the impeller blades are closest to the internal wall of the casing where the chambers are narrow so as to be wholly immersed in the rotating liquid ring, while at the opposite end (shown toward the bottom of FIG. 2), where the impeller blades are farthest from the internal wall of the casing, there is provided a fluid outlet 20. In use, steam at high pressure is injected into the fluid inlet 19, which is connected to multiple inlet ports in the narrow chambers so as to strike the impeller blades thereby rotating the impeller, and is emitted at low pressure from the fluid outlet 20. In doing so, the steam makes contact with the liquid in the liquid ring, some of which may be ejected from the fluid outlet 20 with the condensed steam. More significantly, oil is allowed to exit via a liquid outlet 21, which is located near the impeller so as to ensure that the impeller blades are completely filled with liquid where the impeller is closest to the internal wall of the casing. The liquid outlet 21 ensures that the depth of the liquid ring does not increase thereby occupying space in the chambers 15 that must be empty so as to allow for the entry of steam. In order to ensure that the volume of liquid in the liquid ring is properly regulated, there is likewise provided a liquid inlet 22 for pumping liquid into the turbine casing 13. The liquid inlet 22 and the liquid outlet 21 allow the oil level and temperature to be controlled dynamically. The fluid inlet 19 and the fluid outlet 20 are both formed in a static axial bore 23 of the impeller 11 and are fluidly separated from each other.

At the compression zone on the right side of FIG. 2, the rotating liquid radial flow is directed towards the static axial bore 23 of the impeller where the liquid functions as a piston compressor. At the left side of FIG. 2 the radial liquid flow is from the center to the rotating casing and constitutes an expanding zone.

In a LRRC compressor such as described in US 2009/0290993, gas enters the impeller from the central duct at the lower end in proximity to the compression zone.

In contrast thereto, in the LRRC turbine 10 shown in FIG. 2, gas enters the narrow chambers of the impeller via the fluid inlet 19 and thereafter expands inside the impeller towards the turbine blades, where the chambers are large. In the process, the gas expands and undergoes a gas-to-liquid phase change and can therefore operate as the working fluid of a Rankine cycle heat engine, thus avoiding the need for a compressor as is necessary in above-mentioned US 2009/0290993. This requires that the working fluid be such as to change phase, preferably after completing its useful work, whereupon it is condensed and discharged. A suitable working fluid is steam.

Figure 4:
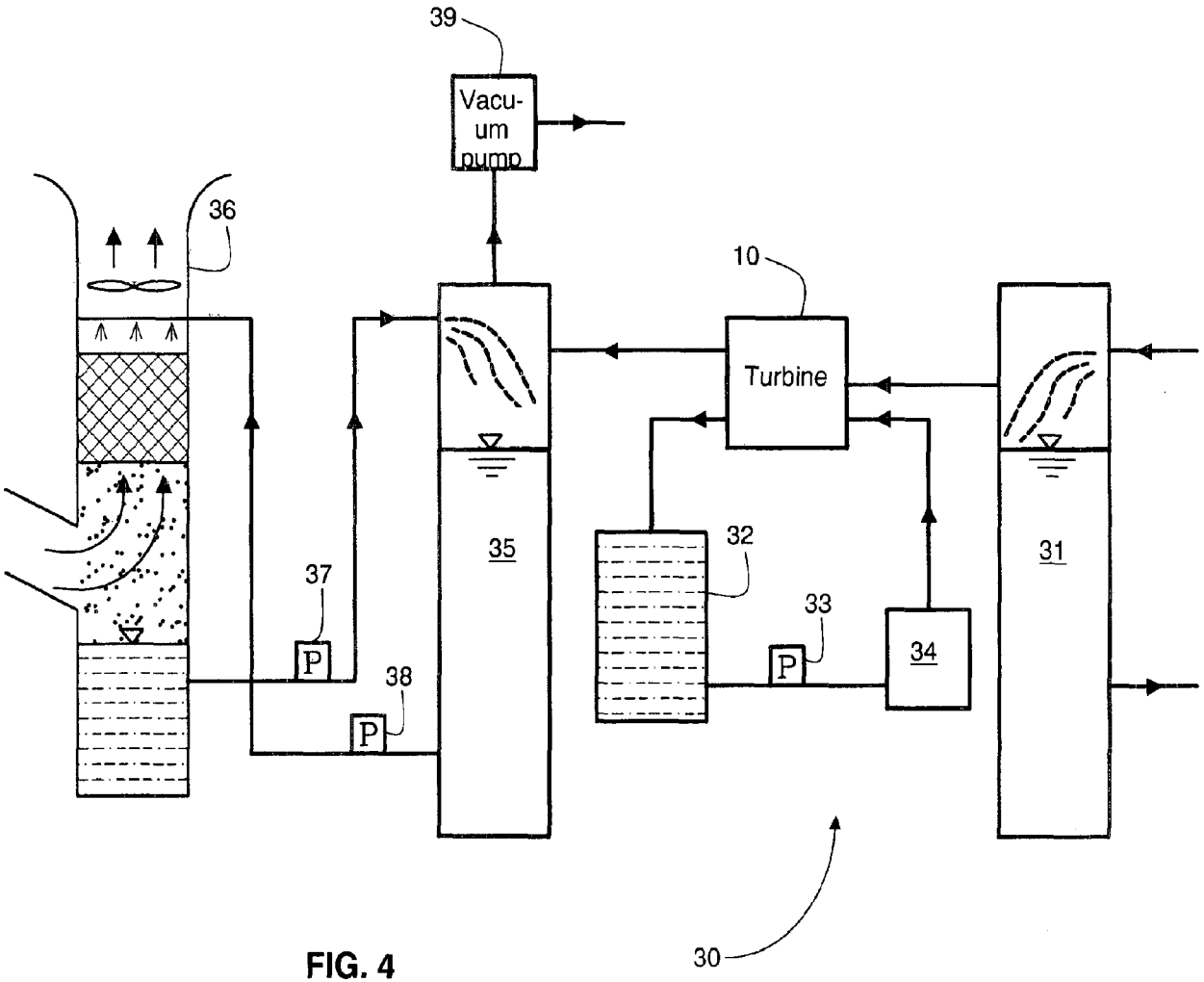
FIG. 4 is a block diagram of a heat engine employing the LRRC steam turbine of FIG. 1.

FIGS. 2 and 4 depict a LRRC steam turbine 30 according to a first embodiment wherein steam is generated by a steam source 31 such as a flash evaporator and fed via the steam inlet shown as 19 in FIG. 2 to a turbine 10 of the kind described above having a rotating liquid ring formed of oil. It expands inside the impeller on its way downwards 30 towards the expanding section of the turbine. The expanded steam enters the central duct 20, which thus constitutes a fluid outlet (depicted by arrows on the right of the central ducts in FIG. 2). Oil stored in a reservoir 32 is pumped by a pump 33 to an oil heater 34 and the heated oil is injected into the liquid ring fluid inlet shown as 22 in FIG. 2. Any oil that exits from the liquid outlet 21 of the turbine is allowed to replenish the oil in the reservoir 32. Steam exiting from the fluid outlet 20 of the turbine enters an external steam condenser 35 wherein steam is introduced at high pressure into a fluid inlet thereof. A source of cold water, such as cooling tower 36, sprays cold water by means of a pump 37 into the condenser 35 thereby condensing the steam exiting from the fluid outlet 20 of the turbine. The water in the condenser becomes heated owing to the condensation of steam and is pumped back to the cooling tower 36 by a pump 38 where the heat is dissipated to the atmosphere. The condenser 35 must operate under very low pressure in order to ensure efficient condensation. In order to preserve low air pressure, any gases that enter the condenser 35 and cannot be condensed are removed by a vacuum pump 39.

Figure 1:
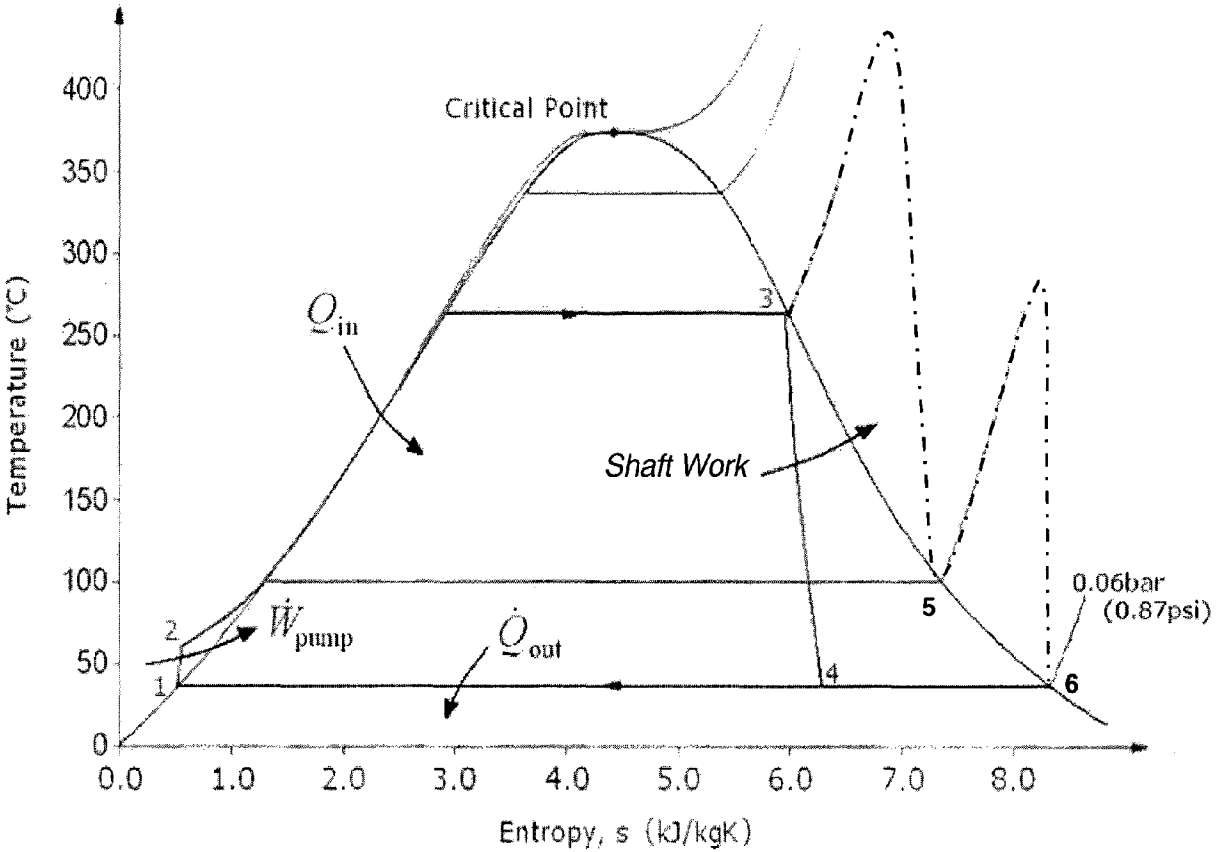
FIG. 1 is a Temperature-Entropy diagram for the conventional Rankine cycle useful for explaining where the invention departs from conventional steam turbines.

In a preferred embodiment, the liquid ring is formed of a type of oil that is denser than water and immiscible therewith, and may be maintained at a higher temperature than the steam in order to avoid steam condensation on the liquid ring. Since the working fluid is completely immiscible with the oil in the liquid ring, only working fluid (e.g. condensed steam) exits from the fluid outlet 20 into the central static duct 21 in FIG. 1.

Figure 3:
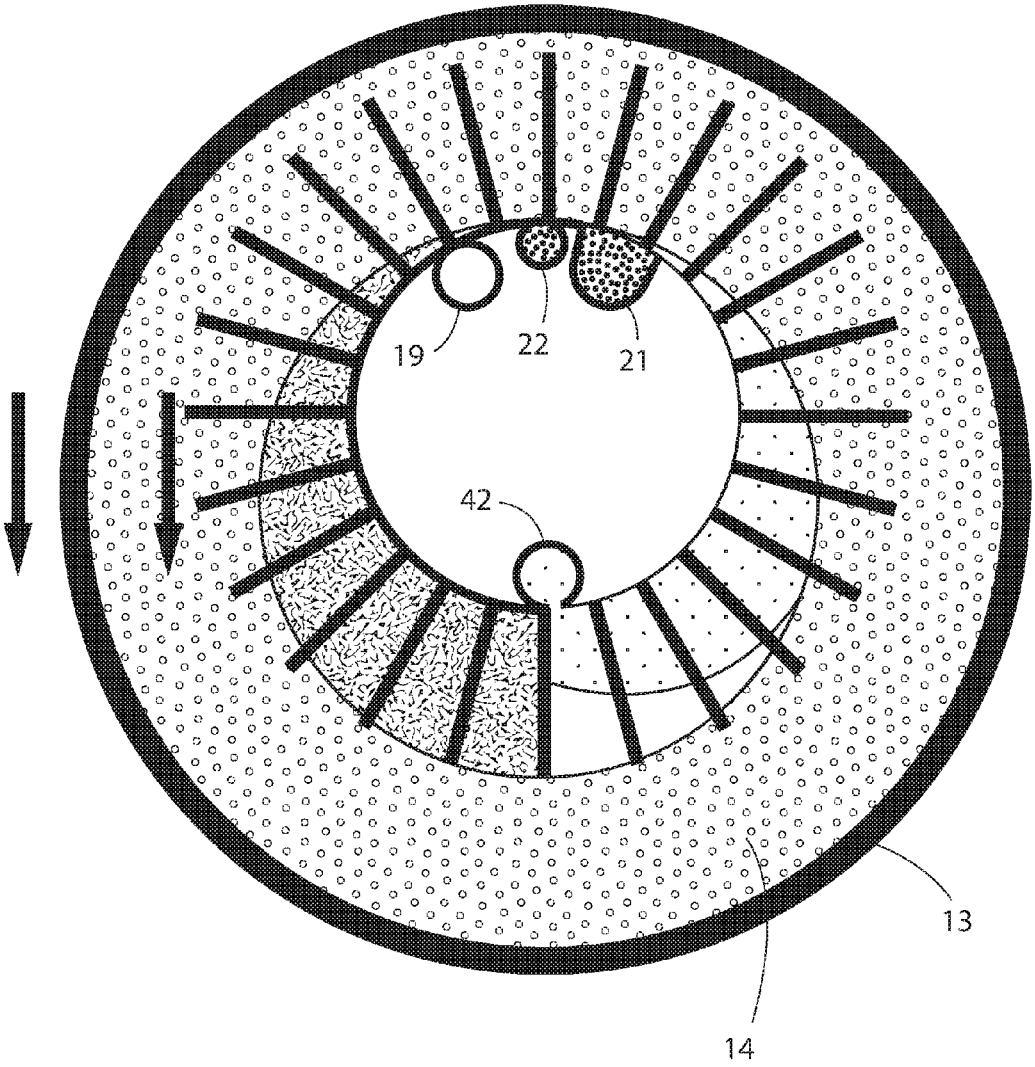
FIG. 3 shows schematically a cross-section of a LRRC steam turbine having an internal steam condenser according to a first embodiment of the invention.
Figure 5:
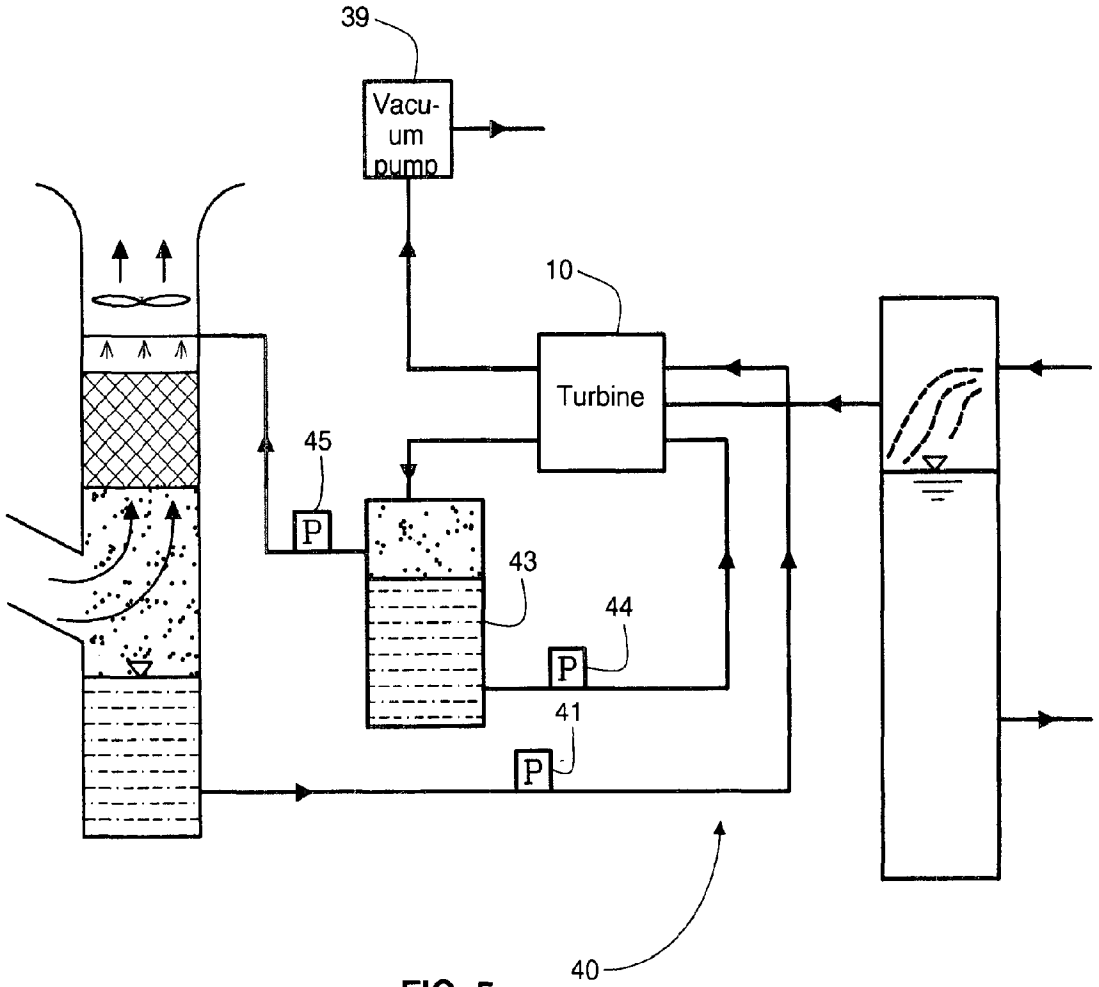
FIG. 5 is a block diagram of a heat engine employing the LRRC steam turbine of FIG. 3.
Figure 6:
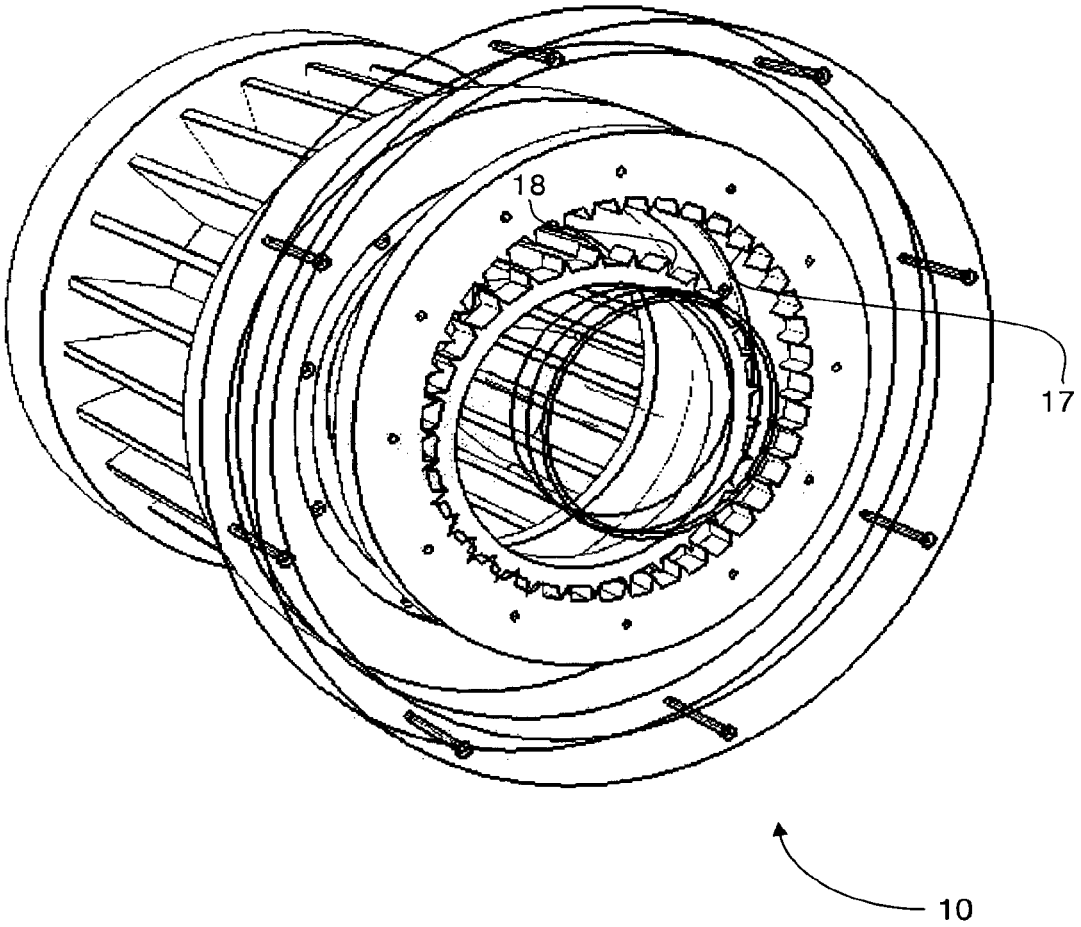
FIG. 6 is a pictorial perspective view of a heat engine according to the invention.

FIGS. 3 and 5 show another embodiment of a heat engine 40 where common features are designated by the same reference numerals as shown in FIG. 4 and operate in like manner. Cold water from a cooling tower 36 is pumped by a pump 41 and sprayed inside the turbine 10 via spray nozzles 42 (shown in FIG. 3), and is used as a steam condenser, thus obviating the need for an external condenser as shown in FIG. 4. The hot water is collected at the oil reservoir 32 as a mixture of water and dense oil and flows to a liquid separator 43 shown in FIG. 5 from where the oil is pumped by a pump 44 back to the turbine and hot water is pumped by a pump 45 back to the cooling tower 36 where it is cooled and returns as cold water to the cold water spray nozzles 42 in FIG. 3. Steam generated by a steam source 31 such as a flash evaporator is fed via the steam inlet shown as 19 in FIG. 3 to a turbine 10.

In this embodiment, there are three inputs to the turbine since an additional inlet is required for the cold water spray and, as noted, there is thus no need for an external condenser. There is likewise no need for an oil heater, which will in any case be heated by the steam. To the extent that the liquid in the liquid ring is cooler than the incoming working fluid, the working fluid may condense on the liquid ring. This is obviously not desirable since the working fluid in its gaseous state is what drives the impeller. On the other hand, it will be understood that as a result of condensation of the working fluid, the liquid in the liquid ring becomes heated and an equilibrium state is created that impedes further condensation. For this reason, it is believed that water may also be used as the liquid ring.

While in the embodiment described above, a heated oil ring is proposed in order to avoid condensation of the steam, this may give rise to undesirable mixing forming an oil-water emulsion which may be undesirable.

Furthermore, reverting to FIG. 2, steam enters the fluid inlet 19 at the upward left side of the turbine and heats the water ring in contact therewith. The heated liquid ring cools during the few milliseconds that it takes to rotate through 2-3 radians (approx. 180°) when it approaches the lower end section of the turbine. Consequently, some of the steam is absorbed by the liquid ring and does not generate shaft work.

For these reasons it is more effective to use a desiccant liquid ring such as brine, which avoids both of these drawbacks. As before, steam enters the fluid inlet 19 and, upon encountering the liquid desiccant ring in the expanding zone, the steam condenses on the liquid interface. The diffusion of water inside the liquid brine is extremely small (approximately $10^{-9}$ $m^2/s$) and the water depth at the brine steam interface will be only several microns. Within a short time interval of only several milliseconds the liquid ring interface will face low pressure steam (at the lower end of FIG. 3) and the water at the brine liquid interface will evaporate to the exit steam. Consequently, only a small fraction of the steam will travel with the liquid ring and the bulk of the steam will expand and induce effective work.

The invention also contemplates a method for generating shaft work using the turbine as described.

The invention claimed is:

1. A liquid ring rotating casing steam turbine, comprising:

a casing mounted for rotation about a first axis and having an inner cylindrical surface surrounding a liquid ring that is warmer than the steam so as to inhibit condensation of the steam upon contact with said liquid ring;

an impeller mounted for rotation eccentrically in said casing about a second axis parallel to and spaced from said first axis, said impeller forming a static axial bore;

said impeller having a plurality of vanes spaced from each other around said bore with each vane extending outwardly from said bore to a tip in a radial direction with respect to said second axis such that the vanes form multiple chambers that are directed towards and lie within said inner cylindrical surface;

a steam inlet within the static axial bore of the impeller for injecting a steam at high pressure into the impeller where the chambers are narrow so as to rotate the impeller and in so doing to expand said steam essentially isentropically within a plurality of said chambers so that said steam at least partially undergoes a steam-to-liquid phase change in the impeller to convert heat to work; and a steam outlet within the static axial bore of the impeller and fluidly separated from the steam inlet for allowing the expanded steam to escape at low pressure and low temperature.

2. The turbine according to claim 1, including a mechanical coupling between the impeller and the casing.

3. The turbine according to claim 1, wherein said steam is adapted to condense upon direct contact with a cold liquid condenser located outside the turbine.

4. The turbine according to claim 1, wherein in use said steam changes phase from steam to liquid without the need for compression.

5. The turbine according to claim 1, wherein the liquid ring is immiscible with water.

6. The turbine according to claim 1, wherein the liquid ring is water or oil or brine.

7. A heat engine comprising the rotating liquid ring rotating casing steam turbine according to claim 1.

8. The turbine according to claim 1, further including:

a first pump coupled to a source of cold water for spraying cold water into a condenser thereby condensing the steam exiting from said steam outlet of the turbine, a second pump coupled to a reservoir containing liquid forming the liquid ring, said second pump being configured to pump said liquid to the turbine, a third pump for pumping water to the source of cold water, and a heater coupled to an outlet of said reservoir for heating said liquid prior to pumping said liquid to the turbine.

9. The turbine according to claim 1 which includes a condenser for condensing steam escaping from said steam outlet so as to subject the steam to a change in phase from steam to liquid at low pressure whereby the steam escaping from the steam turbine is changed to a liquid at low pressure.

* * * * *